US007175505B1

(12) United States Patent
Ko et al.

(10) Patent No.: US 7,175,505 B1
(45) Date of Patent: Feb. 13, 2007

(54) METHOD FOR ADJUSTING SUBSTRATE PROCESSING TIMES IN A SUBSTRATE POLISHING SYSTEM

(75) Inventors: Sen-Hou Ko, Sunnyvale, CA (US); Harry Q. Lee, Los Altos, CA (US); Wei-Yung Hsu, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/328,959

(22) Filed: Jan. 9, 2006

(51) Int. Cl.
*B24B 49/00* (2006.01)

(52) U.S. Cl. ..... 451/5; 451/8; 451/6

(58) Field of Classification Search ..... 451/5, 451/6, 8–11, 41, 57, 59, 65, 285–289; 438/690–693
See application file for complete search history.

(56) References Cited

U.S. PATENT DOCUMENTS 6,530,822 B1 * 3/2003 Lin ..... 451/11
6,623,333 B1 * 9/2003 Patel et al. ..... 451/9
6,827,629 B2 * 12/2004 Kim et al. ..... 451/5
6,939,198 B1 * 9/2005 Swedek et al. ..... 451/5
7,004,814 B2 * 2/2006 Chen et al. ..... 451/5
2005/0020185 A1 * 1/2005 Zuniga et al. ..... 451/5

* cited by examiner

*Primary Examiner*—Dung Van Nguyen
(74) *Attorney, Agent, or Firm*—Patterson and Sheridan

(57) ABSTRACT

Aspects of the present invention include a method and an apparatus that may be utilized to adjust processing times in a substrate processing system. In one embodiment of the present invention, a pre-processing thickness measurement of a substrate while the substrate is in one of the polishing stations is taken. Then the substrate is processed in the polishing system for a predetermined processing time. A post-processing thickness measurement is taken while the substrate is in one of the polishing stations. A removal rate is calculated based on the pre-processing and the post-processing measurements and the predetermined processing time. A processing time is adjusted for one or more of the polishing stations based on the removal rate for use in subsequent processing of a production substrate.

23 Claims, 7 Drawing Sheets

METHOD FOR ADJUSTING SUBSTRATE PROCESSING TIMES IN A SUBSTRATE POLISHING SYSTEM

BACKGROUND OF THE INVENTION

1. Field of the Invention

The present invention relates generally to processing substrates, and more particularly to methods and apparatuses for monitoring and controlling removal rate for substrate processing systems.

2. Description of the Related Art

Integrated circuits are typically formed on substrates, particularly silicon wafers, by the sequential deposition of conductive, semiconductive or insulative layers. After each layer is deposited, a layer may be etched to create circuitry features. As series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface. In addition, planarization is often needed to remove a filler layer until an underlying stop layer is exposed, or to create a layer with a defined thickness.

Chemical mechanical processing (CMP) is one accepted method of planarization. This planarization method typically requires that the substrate be mounted on a carrier or a polishing head. Conventionally, the exposed surface of the substrate is placed against a rotating polishing pad, although a linear belt or other polishing surface can be used. The polishing pad may be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad (also, some polishing processes use a "nonabrasive" process) in a CMP process.

An important step in a CMP process is determining whether the polishing process is complete, i.e., whether a substrate layer has been planarized to a desired flatness or thickness or whether an underlying layer has been exposed. If an excessive amount of material is removed (overpolishing), the substrate is rendered unusable. On the other hand, if an insufficient amount of material is removed (underpolishing), the substrate must be reloaded into a CMP apparatus for further processing.

Therefore, the removal rate of CMP apparatuses is an important variable to monitor. Various methods are used to measure the layer thickness before and after a polishing step in order to calculate the removal rate of a CMP apparatus. Removal rate of a CMP apparatus is generally monitored in order to schedule a sufficient processing time for each CMP step. For example, a spectrometer, such as the NovaScan 210, manufactured by the Nova Corporation of Israel, can be used as an in-line metrology device to measure the thickness of one or more layers in the substrate before and after a process step in a polishing station in order to calculate the removal rate.

As illustrated in FIG. 1, a substrate processing system 100 includes a CMP polisher 22, a wet robot 24, a cleaner 26, a factory interface module 28, and an in-line metrology station 30, which includes a metrology device 60. In a standard process, substrates 11 are transported to the substrate processing system 100 in cassettes 12, and are extracted from the cassettes 12 by a robot 18 in the factory interface module 28 for transport to the polisher 22 or cleaner 26 or metrology device 60. Illustratively, the polisher 22 includes three polishing stations 25*c*, 25*b*, and 25*a*, and a transfer station 27.

Each processing station may perform a different function. As an example, a first polishing station 25*c* may be provided for bulk material removal through a first CMP process, a second polishing station 25*b* may be provided for residual material removal through a second CMP process, and a third polishing station 25*a* may be provided for barrier layer material removal through a third CMP process. At each of the three polishing stations 25*c*, 25*b*, and 25*a*, a substrate 11 undergoes a polishing process defined by processing time based on a removal rate.

It is well known in the art that a removal rate for each process may vary over time due to factors such as: pad wear, variation in slurry composition, variations in the composition of the layers being removed, and other such factors. FIG. 2 illustrates exemplary variation in the removal rate of blanket (or calibration) substrates over a number of processing runs in a polishing station 25. As illustrated, after 500 processes, the polishing rate is approximately 350 Angstroms per minute. Subsequently, the polishing rate drops well below 350 Angstroms per minute after 1100 processing runs. Unless processing time is adjusted accordingly, the variations in removal rate will lead to non-uniform substrate thicknesses.

Therefore, to monitor removal rate, in conventional processing systems, a number of substrates 11 are periodically transferred into a metrology device 60 for thickness measurements before and after processing by the polishing stations 25*c*, 25*b* and 25*a*. A removal rate, calculated based on the measured thicknesses before and after processing, may then be used to adjust the processing time (duration) of one or more of the polishing stations 25 in CMP polisher 22. Overall operations, including adjusting polishing times, may be controlled by controller 32, which may include one or more programmable digital computers executing any appropriate control software. The controller 32 may obtain thickness measurements from the metrology device 60, calculate a removal rate, and adjusts processing times for one or more of the polishing stations 25*c*, 25*b*, and 25*a*, accordingly.

Although measuring removal rate is important to the overall processing of substrates, it adds to the overall processing time, since it requires the transfer of substrates to metrology device 60 and thus adversely affects the system throughput (number of substrates per hour). Further, an in-line metrology tool adds significantly to the overall cost of the system.

Therefore, there is a need for an improved method and apparatus for measuring removal rate in a CMP system.

SUMMARY OF THE INVENTION

One embodiment provides a method for adjusting substrate processing times in a substrate polishing system having one or more polishing stations. The method generally includes a) taking a pre-processing thickness measurement of a substrate while the substrate is in one of the polishing stations, b) processing the substrate in the polishing system, wherein the substrate is processed in at least one of the polishing stations for a predetermined processing time, c) taking a post-processing thickness measurement of the substrate while the substrate is in one of the polishing stations, d) calculating a removal rate based on the pre-processing and the post-processing measurements and the predetermined processing time, and e) adjusting a processing time for one or more of the polishing stations based on the removal rate for use in subsequent processing of a production.

Another embodiment provides a method for measuring multiple removal rates in a substrate polishing system having two or more polishing stations. The methods generally includes a) taking a first pre-processing thickness measurement of a substrate prior to processing the substrate is in a first polishing station, b) taking a first post-processing thickness measurement of the substrate after processing the substrate in the first polishing station for a first processing time, c) taking a second post-processing thickness measurement of the substrate after processing the substrate in a second polishing station for a second processing time, and d) adjusting the first and second processing times, for use in polishing production substrates in the first and second stations, based on the first pre-processing thickness measurement, and the first and second post-processing thickness measurements, wherein each of the thickness measurements are taken while the substrate is in one or more of the polishing stations.

Another embodiment provides a substrate polishing apparatus comprising one or more polishing stations, wherein at least one of the polishing stations includes a measuring device to provide one or more signals indicative of pre-processing and post-processing thicknesses of one or more layers formed on the substrate, wherein the signals are provided while the substrate is in the polishing station, and a controller adapted to adjust processing times for one or more of the polishing stations based on the signals indicative of the pre-processing and post-processing thicknesses.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide methods and apparatus that may be utilized to adjust processing times in a substrate processing system. For example, by utilizing in-situ measurement techniques (e.g., while a substrate is in a polishing station), removal rates may be calculated without the added cost and processing time associated with an external metrology station.

While the description of the system is described with reference to a CMP apparatus and method for planarization, the same technique may be applied to other polishing methods and tools such as electrochemical and mechanical polishing (ECMP) systems and etc.

An Exemplary System

Figure 1:
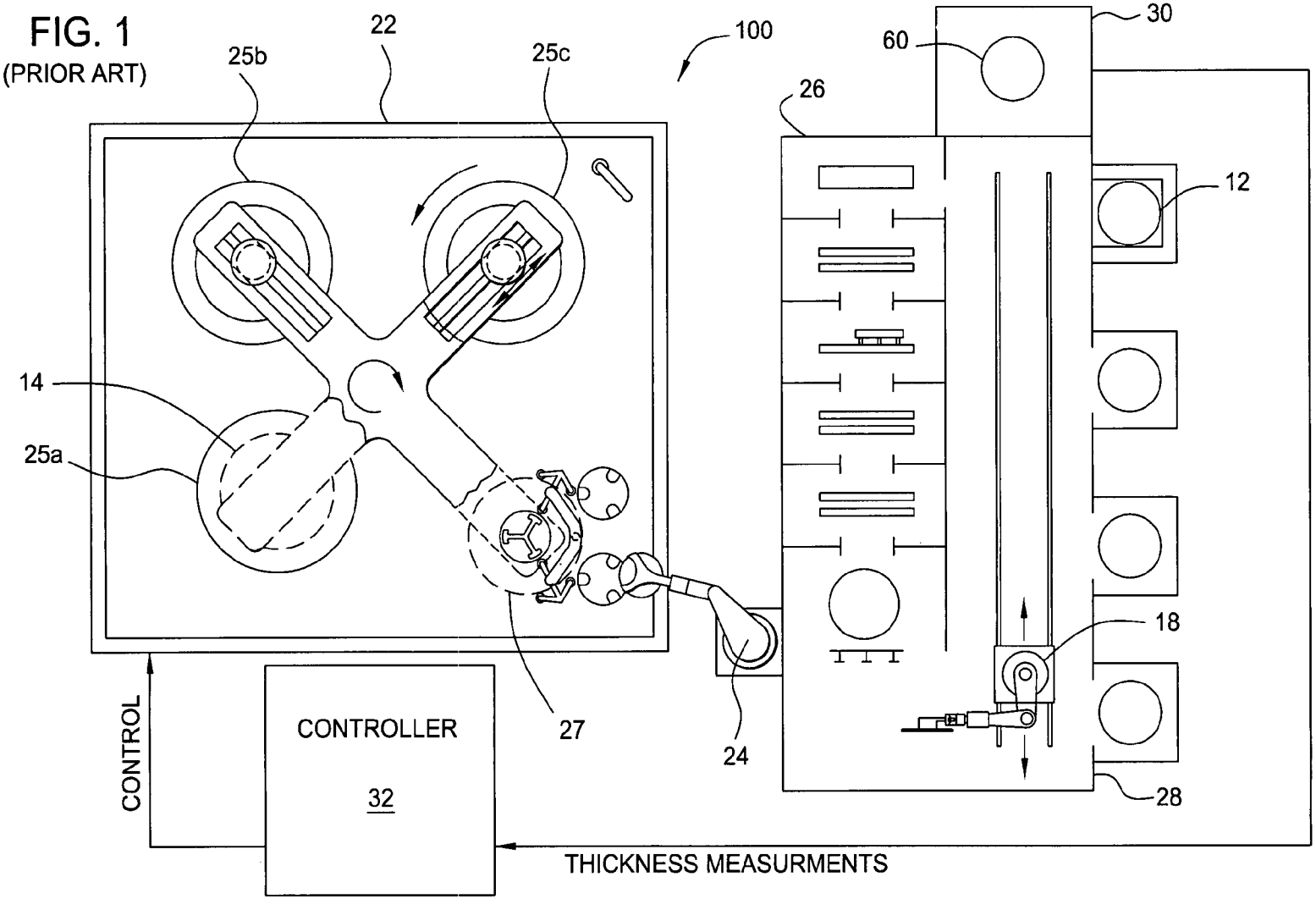
FIG. 1 (PRIOR ART)
FIG. 1 depicts a schematic plan view of a substrate processing system according to prior art.
Figure 2:
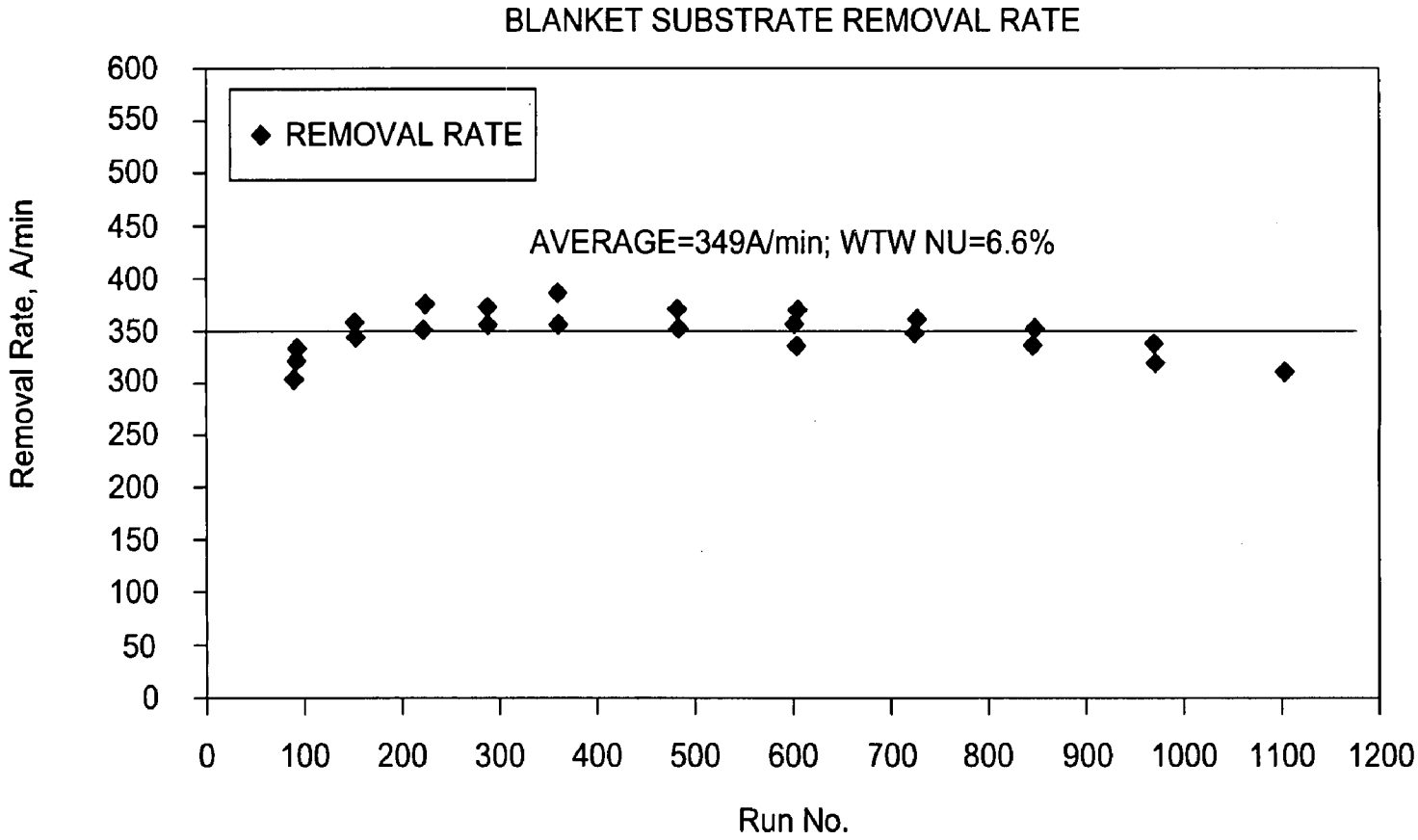
FIG. 2 depicts a graphical representation of removal rate drift of a substrate processing system.
Figure 3:
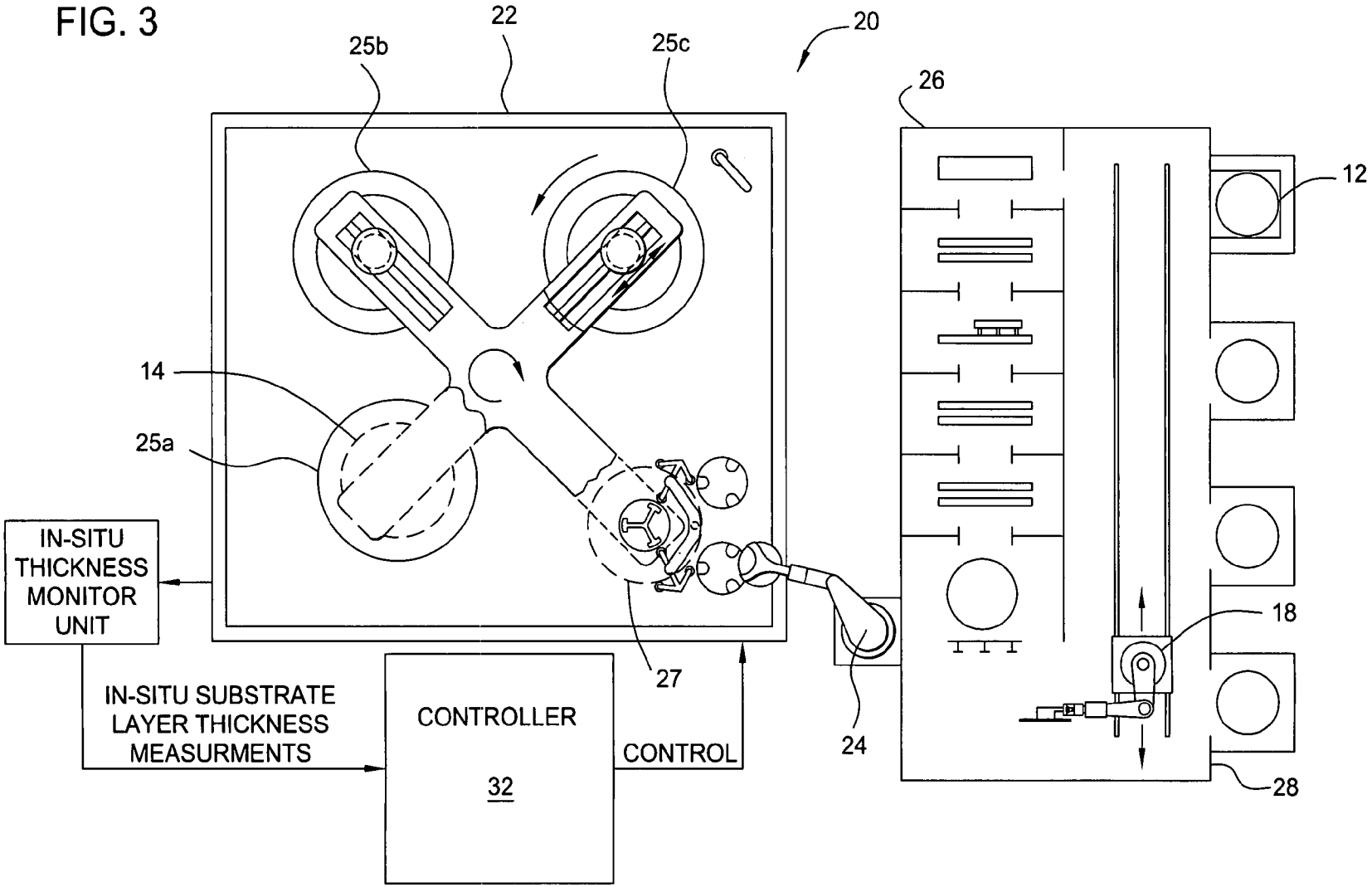
FIG. 3 depicts a schematic plan view of a substrate processing system according to an embodiment of the present invention.

FIG. 3, shows a substrate processing system 20 capable of calculating removal rates of polishing process and adjusting processing times thereof in accordance with one embodiment of the present invention. As illustrated, the substrate processing system 20 may include a CMP polisher 22, a wet robot 24, a cleaner 26, and a factory interface module 28. However, the substrate processing system 20 does not require a separate metrology station to measure substrate thickness in order to calculate the removal rate. Rather, removal rates may be monitored utilizing in-situ measurements of a blanket/calibration substrate as describe herein.

In the substrate processing system 20, blanket substrates 10 may be transported to the substrate processing system 20 in cassettes 12, and are extracted from the cassettes 12 by a robot 18 in the factory interface module 28 for transport to CMP polisher 22 or cleaner 26. The operations of the substrate processing system 20 are coordinated by controller 32. The polisher 22 can be a Mirra® chemical mechanical polisher manufactured by Applied Materials, Inc. of Santa Clara Calif. An exemplary CMP polisher includes three polishing stations 25*c*, 25*b* and 25*a*, and a transfer station 27. At each polishing station 25*c*, 25*b*, and 25*a*, a production substrate polishing process is defined by the controller 32 based on the removal rate calculated by in-situ measurement of pre-processing and post-processing of blanket substrate thickness measurements obtained by a system as described herein.

Embodiments of the present invention allow for accurate removal rate calculations by measuring pre-processing and post-processing layer thicknesses of a blanket substrate in-situ by employing a measuring system and using the measured data to adjust the polishing time for one or more production substrates. The in-situ measurements may be made using any suitable measurement techniques, for example, utilizing eddy current, capacitive or vibration measurements.

An Exemplary In-situ Measurement System

Figure 4:
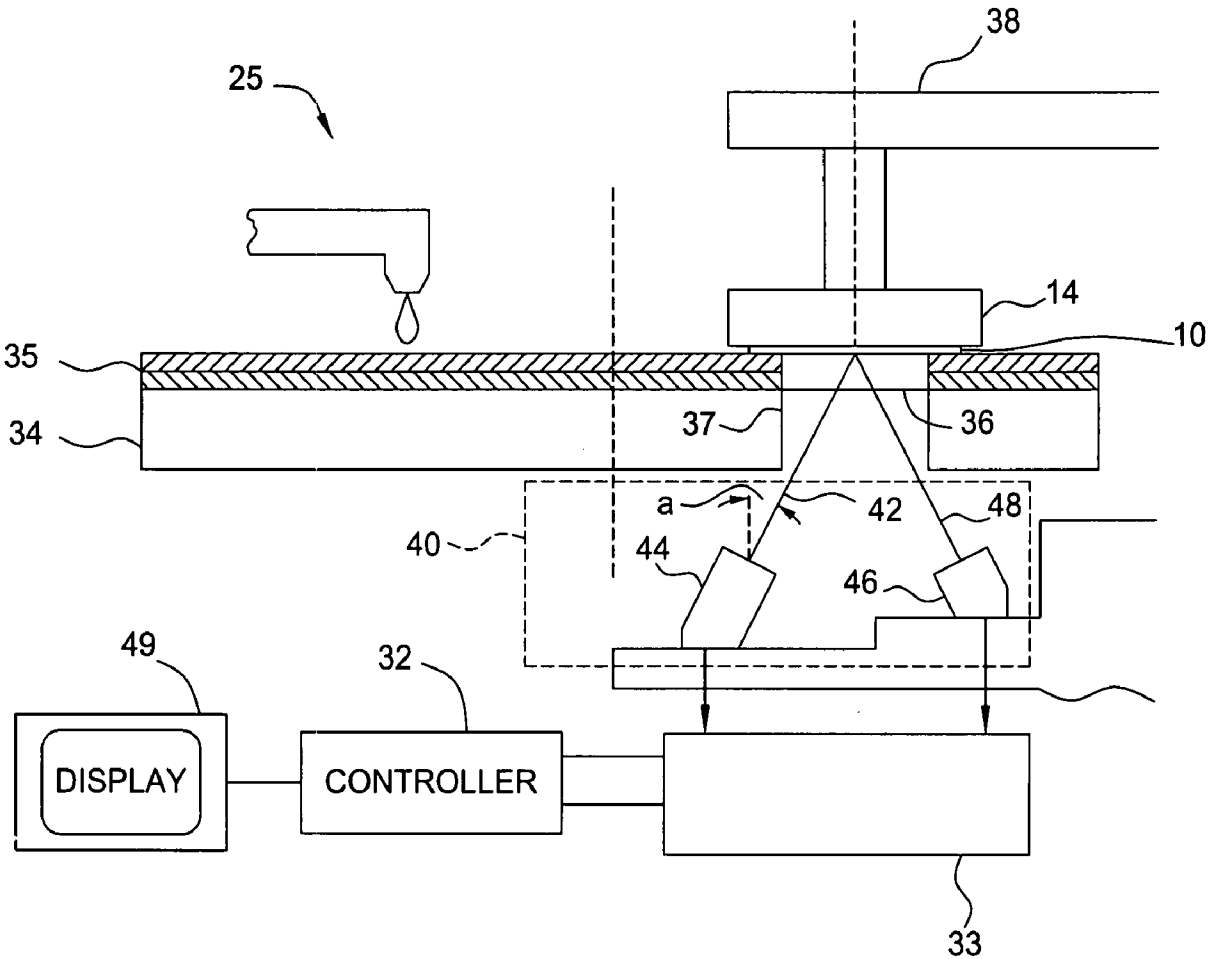
FIG. 4 depicts a schematic cross-sectional view of a polishing station in the substrate processing system according to an embodiment of the present invention.

FIG. 4 depicts a schematic cross-sectional view of a polishing station 25*a* in the substrate processing system 20 according to an embodiment of the present invention. In one embodiment of the present invention, as illustrated in FIG. 4, a thickness measuring system 40 is used to measure the pre-processing and post processing thickness of blanket substrates in order to calculate the removal rate of the polishing stations in the CMP polisher 22. FIG. 4 illustrates a polishing station 25 with a rotatable platen 34 that supports a polishing pad 35, e.g., a standard or a fixed-abrasive or polishing pad. A support structure 38 supports a carrier head 14 that holds a substrate 11 against the polishing pad 35. An aperture 37 is formed in the platen 34, and a transparent window 36 is formed in a portion of the polishing pad 35 overlying the aperture.

The thickness measuring system 40, which can function as a reflectometer, or interferometer, or spectrophotometer is secured to the platen 34 beneath the aperture 37 and rotates with the platen 34. The thickness measuring system 40 includes a light source 44, such as a laser or a flash lamp, and a detector 46, such as a photodiode or a charge-coupled device (CCD). The light source generates a light beam 42 which propagates through transparent window 36 to impinge upon the exposed surface of the substrate 11. The intensity of a reflected beam 48 from the substrate 11 is measured by the detector 46.

In one embodiment of the present invention, in operation, the polisher 22 uses the thickness measuring system 40 to determine the thickness of a blanket substrate before, during and after polishing. In this embodiment, the light source 44 and the detector 46 are coupled to the controller 32 via in-situ thickness monitor unit 33. The controller 32 may be a general purpose digital computer programmed to: activate the light source 44 when the substrate generally overlays the window, store intensity measurements from the detector 46, display the intensity measurements on an output device 49, sort the intensity measurements into radial ranges, and apply logic to the measured signals to measure substrate thickness. As such, thickness measuring system 40 may be used to measure substrate thicknesses before, during and after processing.

In some embodiments of the present invention, the controller 32 is adapted to generate an alert when the removal rate differs from a threshold value (e.g., a value selected by the user) by a predetermined amount. This feature will enable an operator to promptly attend to substrate processing system 20 for service or inspection.

In some other embodiments of the present invention, the controller 32 is adapted to generate an alert when a post-processing layer thickness differs from a threshold value (e.g., a value selected by the user) by a predetermined amount. This feature will enable an operator to prompt the system to deliver a second blanket substrate to the transfer station 27 to replace the first blanket substrate. In other embodiments, the system will automatically replace the first blanket substrate with a second substrate when a post-processing thickness measurement differs from a threshold value by a pre-determined amount.

Exemplary Operations Utilizing In-situ Measurements

Figure 5:
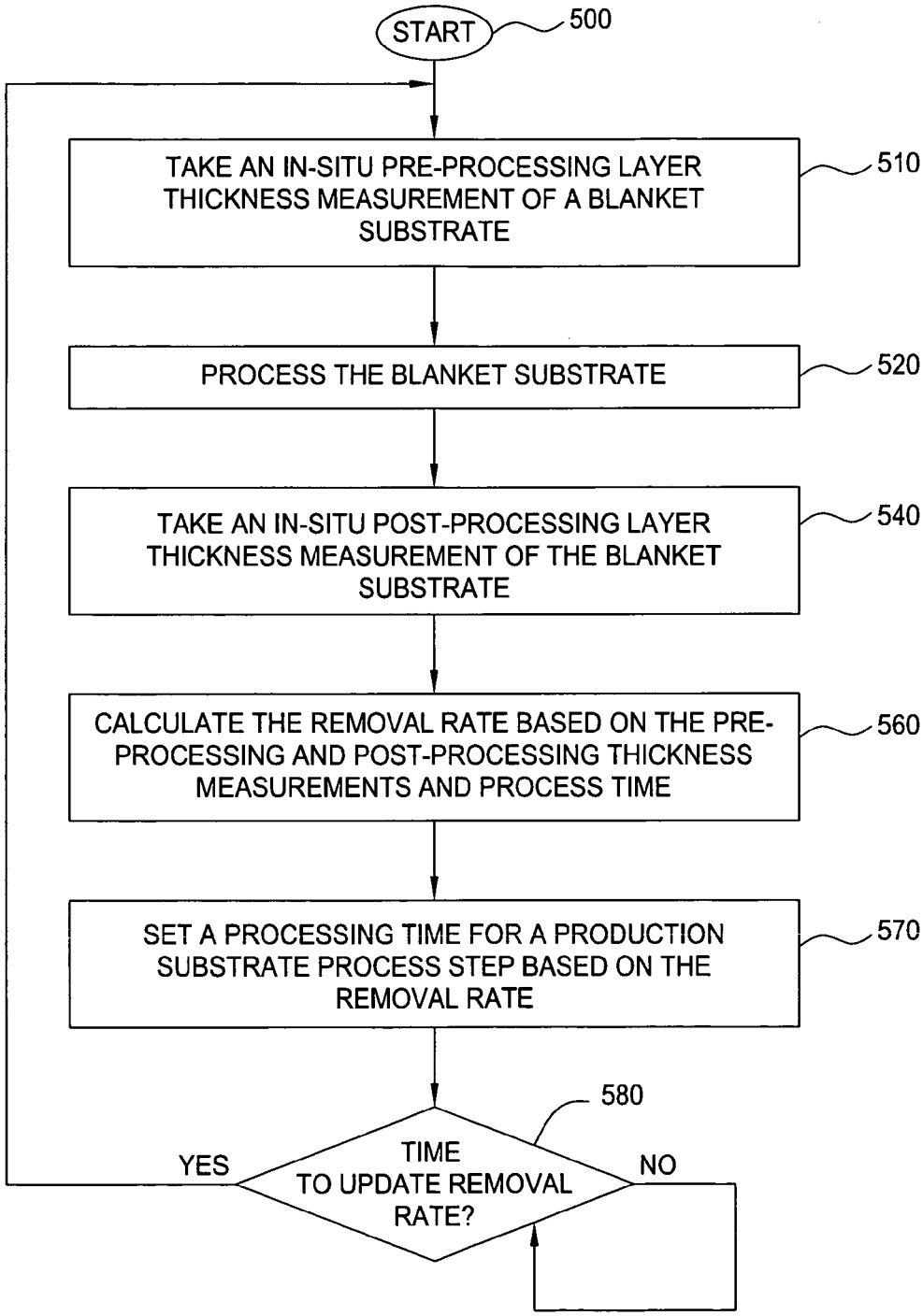
FIG. 5 depicts a flow diagram of a processing method according to an embodiment of the present invention.

FIG. 5 illustrates operations 500 according to an implementation of the present invention. The operations of 500 may be performed, for example, by the controller 32. Moreover, various steps in the methods set forth below need not be performed or repeated on the same controller 32. For example, the measurement of the initial substrate thickness could be forwarded to the controller 32 of the substrate processing system 20. Thus, controller 32 could then use the initial substrate thickness value and only measure a post thickness value, and then, calculate the removal rate based on the initial thickness and the measured post processing thickness in order to set a production substrate processing time for a process step. Further, the operations 500 may be understood with occasional reference to FIGS. 3 and 4.

The operations begin, at step 510, by taking an in-situ pre-processing layer thickness measurement of a blanket substrate. For example, initially, a cassette 12 may be delivered to a substrate processing system 20 and then a blanket substrate 10 may be delivered to a polishing station 25. The cassette 12 may include a blanket substrate 10, in addition to a set of regular (i.e., production) substrates 15. The blanket substrate 10 can be a blank oxide-coated wafer. A pre-processing substrate thickness (initial thickness) of a blanket substrate 10 is measured by in-situ thickness measuring system 40 in substrate polishing station 25*a*, as described above with reference to FIG. 3.

At step 520, the blanket substrate is processed. For the processing, the controller 32 may set the polishing time for the blanket substrate to a fixed duration and blanket substrate 10 may be processed for a predetermined amount of time. The controller 32 may halt polishing when the actual polishing time of the blanket substrate becomes equal to the set polish time.

At step 540, a post-processing substrate thickness measurement of the blanket substrate 10 is obtained by in-situ thickness measuring system 40 in a substrate polishing station (e.g., polishing station 25*a*). At step 560, the controller 32 determines the removal rate of the blanket substrate based on the pre-processing and post-processing thickness measurements, for example, obtained via the thickness measuring system 40.

The processing time for processing a production substrate may then be adjusted, at step 570, based on the calculated removal rate. For some embodiments, a wet robot may remove the blanket substrate from polishing station 25. Subsequently, a production substrate 15 may be transferred to the polishing station 25 and is polished using the adjusted processing time, for example, calculated by controller 32. In addition, in some embodiments of the present invention, a regular substrate (i.e., a production substrate) instead of a blanket substrate may be used for processing and removal rate calculation. In other words, a production substrate can be used as a calibration substrate. In other embodiments of the present invention, one or more blanket substrates may be used repeatedly for removal rate calculations.

Further, those skilled in the art will recognize that calculating the removal rate is an intermediate step that may be eliminated. In other words, an algorithm may be used to adjust processing times with the same end result, based on pre and post-processing thickness measurements and a current processing time, without actually calculating removal rate.

Depending on the particular embodiment, the substrate processing system 20 may be configured by controller 32 to prompt the user to repeat steps 510 to 570, at time intervals determined at step 580. In other embodiments, these steps may be set to repeat automatically at step 580. In one embodiment of the present invention, steps 510 to 570 are repeated after processing a fixed number of substrates. In another embodiment of the present invention, steps 510 to 570 are repeated after a substrate processing system 20 has been idle for a limited time. In yet another embodiment of the present invention, steps 510 to 570 are repeated based on regular time intervals in a production environment. Further, operations may be initiated in any combination of these manners.

In some embodiments of the present invention, the frequency with which the operations are repeated to monitor removal rate (steps 510 to 570) may be adjusted based on the rate of change in the most recent calculated values of the removal rate. For example, in some cases a history (log) of removal rates may be kept and, if the removal rate is rapidly changing, the operations may be performed more frequently in order to adjust processing times accordingly. If the removal rate is changing slowly, it may not be necessary to update the processing times as often. However, if the removal rate is changing rapidly (e.g., steadily decreasing), it may be necessary to adjust processing time more frequently to avoid unacceptable variations in layer thickness in production substrate processing. While monitoring removal rate more frequency may have an impact on throughput, this may be offset by an increase in production yield by maintaining uniform layer thickness even while removal rate is rapidly fluctuating.

In some embodiments of the present invention, a predefined number of blanket substrates are processed in a polishing station before a removal rate calculation is performed. In this way, the polishing station is operating optimally when pre-processing and post-processing measurements are taken. In some embodiments of the present invention, this step is repeated when a substrate processing system has been idle for a limited time. In yet another embodiment of the present invention, this step is repeated based on regular time intervals in a production environment.

In other embodiments of the present invention, the controller is adapted to maintain a history (log) of thickness measurements and generate an alert if a thickness measurement differs from a pre-defined value by a pre-determined amount.

Figure 6:
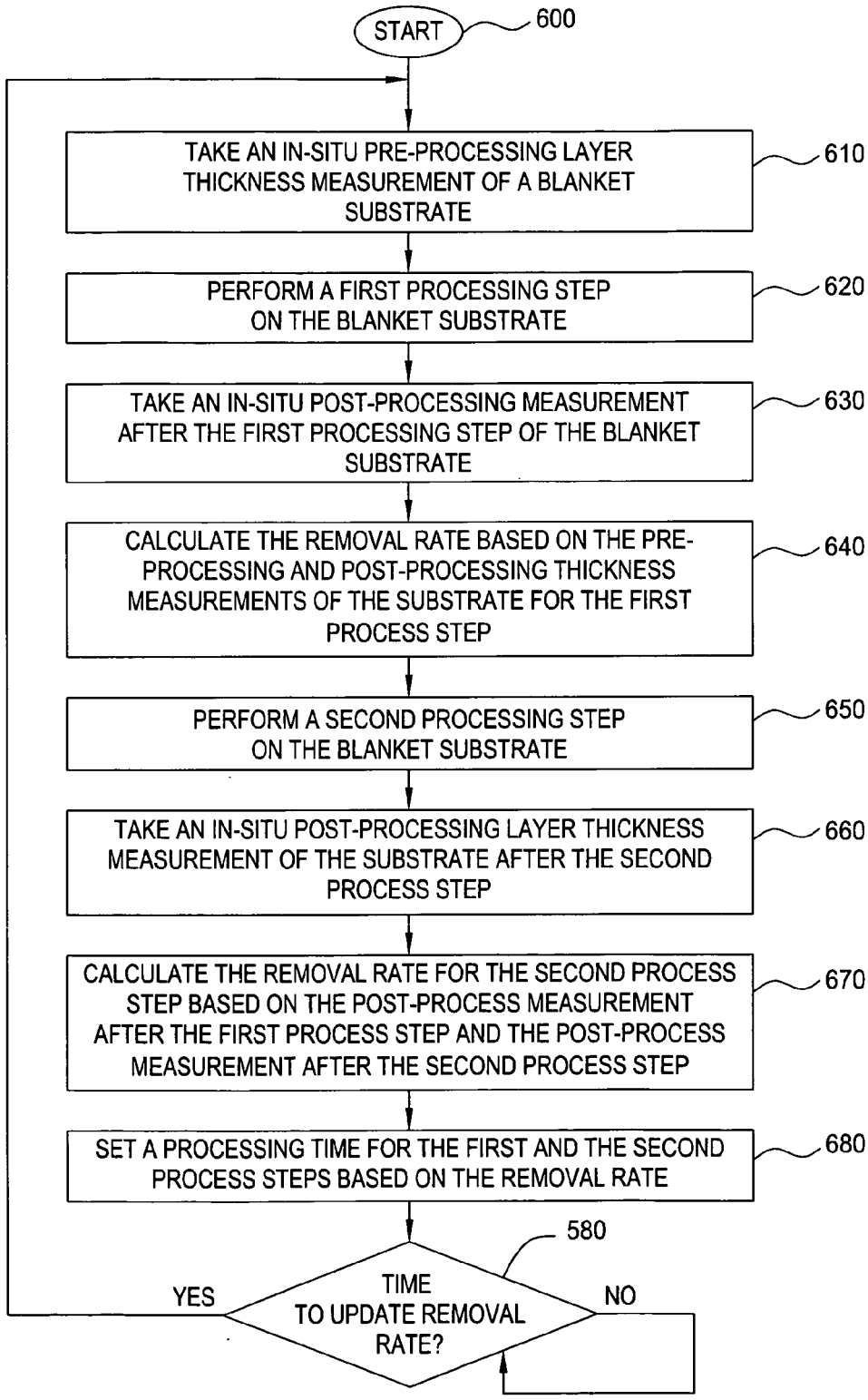
FIG. 6 depicts a flow diagram of a processing method according to another embodiment of the present invention.

FIG. 6 illustrates operations 600 according to another implementation of the present invention. In operations 600, in-situ pre-processing thickness measurement of a blanket substrate and in-situ post-processing thickness measurement of a blanket substrate, processed for multiple fixed periods of time in multiple polishing stations, are used to calculate multiple removal rates (e.g., two in this example) in multiple polishing stations in substrate processing system 20. Accordingly, processing time of multiple polishing stations (e.g., polishing stations 25*b* and 25*a*) may be controlled individually, hence providing greater control over the polishing rates of the overall system to provide for greater thickness uniformity.

The operations begin, at step 610, by taking an in-situ pre-processing layer thickness measurement of a blanket substrate by an in-situ thickness measuring system 40 in a first substrate polishing station (e.g., polishing station 25*b*) as described above with reference to FIG. 3. At step 620, the blanket substrate is processed. For the processing, the controller may set the polishing time for the blanket substrate to a fixed duration and blanket substrate 10 may be processed for a predetermined amount of time. At step 630, a post-processing substrate thickness measurement of the blanket substrate 10 is obtained by in-situ thickness measuring system 40 in a first substrate polishing station (e.g., polishing station 25*b*). At step 640, the controller 32 determines the removal rate for a first process step based on the pre-processing and post-processing thickness measurements, for example obtained via the thickness measuring system 40.

At Step 650, the blanket substrate is transferred from a first polishing station (e.g., polishing station 25*b*) to a second polishing station (e.g., polishing station 25*a*) and the blanket substrate is processed for a second time. The controller 32 may set the polishing time for the blanket substrate in a second polishing station to a second fixed duration and blanket substrate 10 may be processed for a predetermined amount of time.

At step 660, after the second process step, a post-processing substrate thickness measurement of the blanket substrate 10 is obtained by in-situ thickness measuring system 40 in a second polishing station (e.g., polishing station 25*a*). At step 670, the controller 32 determines the removal rate of the blanket substrate for the second process step for the second polishing station (e.g., polishing station 25*a*) based on the post-processing measurement taken after the first process step obtained in step 630 and the post-processing thickness measurement after the second process step received from the thickness measuring system 40. In other words, the post-process thickness measurement for the first process may be used as the pre-process thickness measurement of the second process. The processing time for each of the two stations (e.g., polishing stations 25*b* and 25*a*) may then be adjusted, based on the calculated removal rates at step 680. The operations 610 to 680 may be repeated in any suitable manner, as described above, for example, based on any suitable events or time duration.

In some embodiments of the present invention, a polishing head (not shown), after polishing the blanket substrate in the first polishing station (e.g., polishing station 25*b*), moves the blanket substrate from a first polishing station to a second polishing station (e.g., polishing station 25*a*) and continues polishing the blanket substrate in the second polishing station. In this way, the same polishing head is used for moving a blanket substrate from a first polishing station to a second polishing station for a second processing step.

Figure 7:
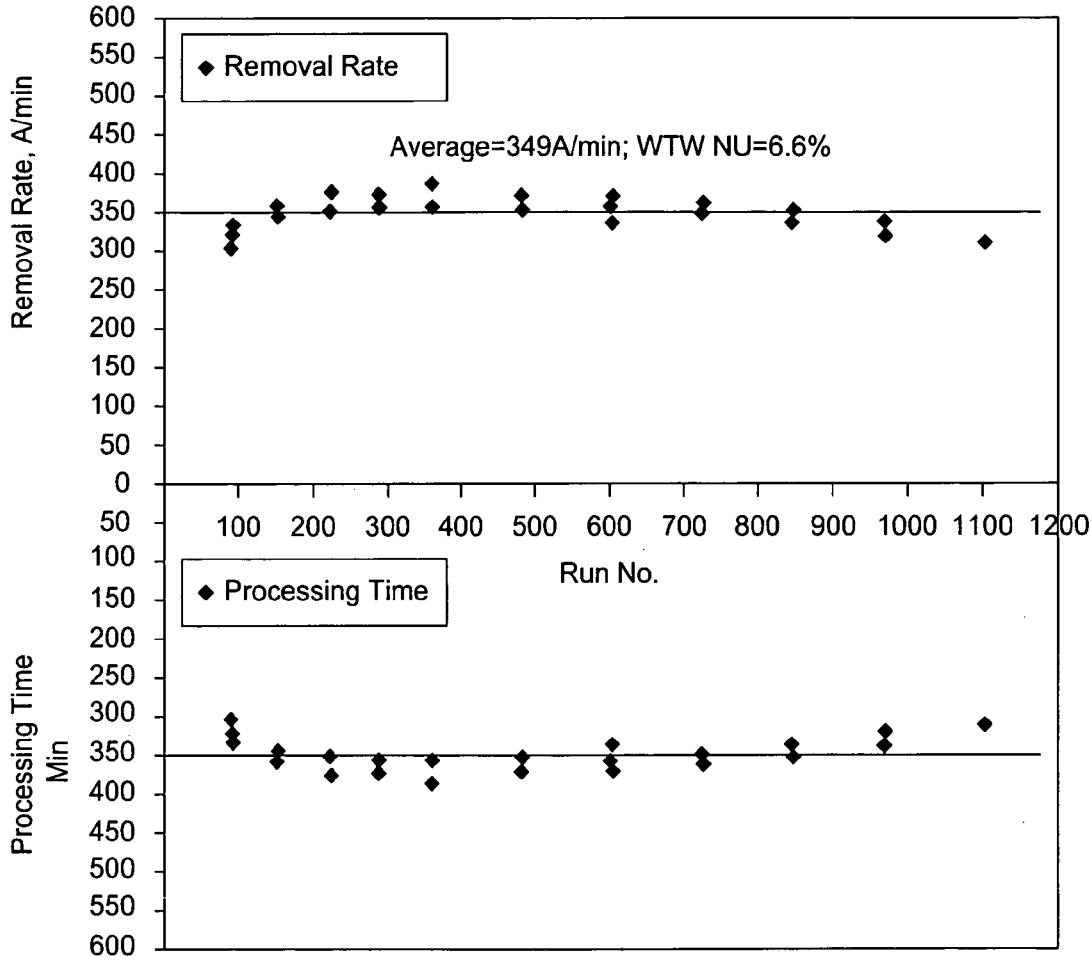
FIG. 7 depicts a graphical representation of removal rate drift of a substrate processing system and adjustment of the processing time with respect to the removal rate drift according to an embodiment of the present invention.

FIG. 7 illustrates how processing times may be adjusted to compensate for variations in removal rate of a blanket substrate, in accordance with embodiments of the present invention. As shown, for example, after processing 500 substrates, the polishing rate is approximately 350 Angstroms per minute, and then the polishing rate drops well below 350 Angstroms per minute after 1100 processes. After measuring this removal rate, for example, using the techniques described above, the processing time may be adjusted accordingly in an effort to compensate for the variation of the removal rate and maintain uniform layer thicknesses.

As illustrated, there will generally be an inverse relationship between removal rate and processing time. While FIG. 7 illustrates adjusting the processing time of only one processing station, it should be obvious that a similar relationship will hold if the processing time of multiple processing stations is adjusted based on corresponding removal rates.

CONCLUSION

By taking in-situ thickness measurements of a blanket substrate before and after processing, removal rates may be calculated and processing times may be adjusted accordingly. By performing the thickness measurements in-situ, the need for an external metrology station for this purpose is eliminated. As a result, embodiments of the present invention may reduce overall processing time and overall system cost.

Although the embodiment disclosed above, which incorporates the teaching of the present invention, has been shown and described in detail herein, those skilled in the art can readily devise other varied embodiments which still incorporate the teachings and do not depart from the spirit of the invention.

The invention claimed is:

1. A method for adjusting substrate processing times in a substrate polishing system having one or more polishing stations, comprising:

a) taking a pre-processing thickness measurement of a calibration substrate while the calibration substrate is in one of the polishing stations;

b) processing the calibration substrate in the polishing system, wherein the calibration substrate is processed in at least one of the polishing stations for a predetermined processing time, wherein the processing is performed in an electrochemical mechanical polishing station;

c) taking a post-processing thickness measurement of the calibration substrate while the calibration substrate is in one of the polishing stations;

d) calculating a removal rate based on the pre-processing and the post-processing measurements and the predetermined processing time; and e) adjusting a processing time for one or more of the polishing stations based on the removal rate, wherein the adjusted processing time is used in subsequent processing of a production substrate.

2. A method for adjusting substrate processing times in a substrate polishing system having one or more polishing stations, comprising:

a) taking a pre-processing thickness measurement of a calibration substrate while the calibration substrate is in one of the polishing stations;

b) processing the calibration substrate in the polishing system, wherein the calibration substrate is processed in at least one of the polishing stations for a predetermined processing time;

c) taking a post-processing thickness measurement of the calibration substrate while the calibration substrate is in one of the polishing stations, wherein the taking the thickness measurements are based on signals received from one or more optical monitoring systems;

d) calculating a removal rate based on the pre-processing and the post-processing measurements and the predetermined processing time; and e) adjusting a processing time for one or more of the polishing stations based on the removal rate, wherein the adjusted processing time is used in subsequent processing of a production substrate.

3. The method of claim 2, wherein the taking the thickness measurement comprises generating a light beam, and directing the light beam during a polishing operation through an aperture so that it impinges on the calibration substrate.

4. The method of claim 2, wherein the taking the thickness measurement composes the taking a thickness measurement utilizing a reflectometer.

5. The method of claim 2, wherein the taking the thickness measurement comprises the taking a thickness measurement utilizing an interferometer.

6. A method for adjusting substrate processing times in a substrate polishing system having one or more polishing stations, comprising:

a) taking a pre-processing thickness measurement of a calibration substrate while the calibration substrate is in one of the polishing stations;

b) processing the calibration substrate in the polishing system, wherein the calibration substrate is processed in at least one of the polishing stations for a predetermined processing time;

c) taking a post-processing thickness measurement of the calibration substrate while the calibration substrate is in one of the polishing stations;

d) calculating a removal rate based on the pre-processing and the post-processing measurements and the predetermined processing time;

e) adjusting a processing time for one or more of the polishing stations based on the removal rate, wherein the adjusted processing time is used in subsequent processing of a production substrate;

f) maintaining a log of removal rate calculations;

g) maintaining a log of thickness measurements; and h) repeating steps b)–e) with a frequency determined, at least in part, on variations in the log of removal rate calculations.

7. A method for measuring multiple removal rates in a substrate polishing system having two or more polishing stations, comprising:

a) taking a first pre-processing thickness measurement of a calibration substrate prior to processing the calibration substrate is in a first polishing station;

b) taking a first post-processing thickness measurement of the calibration substrate after processing the calibration substrate in the first polishing station for a first processing time;

c) taking a second post-processing thickness measurement of the calibration substrate after processing the calibration substrate in a second polishing station for a second processing time; and d) adjusting the first and second processing times based on the first pre-processing thickness measurement, and the first and second post-processing thickness measurements, wherein the first and second processing times are used in subsequent polishing of production substrates in the first and second stations;

wherein each of the thickness measurements are taken while the calibration substrate is in one or more of the polishing stations.

8. The method of claim 7, wherein the first polishing station is a chemical mechanical processing polishing station.

9. The method of claim 7, wherein the second polishing station is a chemical mechanical processing polishing station.

10. The method of claim 7, wherein the first polishing station is an electrochemical mechanical polishing station.

11. The method of claim 7, wherein the second polishing station is an electrochemical mechanical polishing station.

12. The method of claim 7, wherein the adjusting the first and the second processing times are based on calculating removal rates based on the pre-processing and the post processing measurements.

13. The method of claim 7, wherein the taking the thickness measurements are based on signals received from one or more optical monitoring systems.

14. The method of claim 13 wherein the taking the thickness measurement comprises the step of generating a light beam, and directing the light beam during a polishing operation through an aperture so that it impinges on the calibration substrate.

15. The method of claim 13, wherein taking the thickness measurement comprises taking a thickness measurement utilizing a reflectometer.

16. The method of claim 13, wherein taking the thickness measurement comprises a taking a thickness measurement utilizing an interferometer.

17. The method of claim 13, wherein taking the thickness measurement comprises a taking a thickness measurement utilizing an spectrophotometer.

18. The method of claim 7, wherein the calibration substrate is a production substrate.

19. A substrate polishing apparatus comprising:

one or more polishing stations, wherein at least one of the polishing station comprises a platen and a measuring device to provide one or more signals indicative of pre-processing and post-processing thicknesses of one or more layers formed on a calibration substrate, wherein the thickness measuring device rotates with the platen during processing and wherein the signals are provided while the calibration substrate is in the polishing station; and a controller adapted to adjust processing times for one or more of the polishing stations based on the signals indicative of the pre-processing and post-processing thicknesses, wherein the adjusted processing times are used in subsequent processing of production substrates.

20. A substrate polishing apparatus comprising:

one or more polishing stations, wherein at least one of the polishing stations includes a measuring device to provide one or more signals indicative of pre-processing and post-processing thicknesses of one or more layers formed on a calibration substrate, wherein the signals are provided while the calibration substrate is in the polishing station; and a controller adapted to adjust processing times for one or more of the polishing stations based on the signals indicative of the pre-processing and post-processing thicknesses, wherein the adjusted processing times are used in subsequent processing of production substrates and wherein the controller is further adapted to maintain a log of removal rates and update the log after each removal rate.

21. A substrate polishing apparatus comprising:

one or more polishing stations, wherein at least one of the polishing stations includes a measuring device to provide one or more signals indicative of pre-processing and post-processing thicknesses of one or more layers formed on a calibration substrate, wherein the signals are provided while the calibration substrate is in the polishing station; and a controller adapted to adjust processing times for one or more of the polishing stations based on the signals indicative of the pre-processing and post-processing thicknesses, wherein the adjusted processing times are used in subsequent processing of production substrates and wherein the controller is further adapted to maintain a log of post thickness measurements and update the log after each measurement.

22. A substrate polishing apparatus comprising:

one or more polishing stations, wherein at least one of the polishing stations includes a measuring device to provide one or more signals indicative of pre-processing and post-processing thicknesses of one or more layers formed on a calibration substrate, wherein the signals are provided while the calibration substrate is in the polishing station; and a controller adapted to adjust processing times for one or more of the polishing stations based on the signals indicative of the pre-processing and post-processing thicknesses, wherein the adjusted processing times are used in subsequent processing of production substrates and wherein the controller is adapted to adjust processing times with a frequency determined based on variations in the log of removal rates.

23. A substrate polishing apparatus comprising:

one or more polishing stations, wherein at least one of the polishing stations includes a measuring device to provide one or more signals indicative of pre-processing and post-processing thicknesses of one or more layers formed on a calibration substrate, wherein the signals are provided while the calibration substrate is in the polishing station; and a controller adapted to adjust processing times for one or more of the polishing stations based on the signals indicative of the pre-processing and post-processing thicknesses, wherein the adjusted processing times are used in subsequent processing of production substrates and wherein the controller is further adapted to generate an alert when the removal rate differs from a threshold removal rate by a predetermined amount.

* * * * *

UNITED STATES PATENT AND TRADEMARK OFFICE

CERTIFICATE OF CORRECTION

PATENT NO. : 7,175,505 B1
APPLICATION NO. : 11/328959
DATED : February 13, 2007
INVENTOR(S) : Ko et al.

It is certified that error appears in the above-identified patent and that said Letters Patent is hereby corrected as shown below:

In the Claims:

In Column 9, Claim 4, Line 52, please delete "composes" and insert --comprises--.

Signed and Sealed this

Tenth Day of July, 2007

JON W. DUDAS
*Director of the United States Patent and Trademark Office*